US010739066B2

(12) United States Patent
Ji et al.

(10) Patent No.: US 10,739,066 B2
(45) Date of Patent: Aug. 11, 2020

(54) REFRIGERATOR CONTROL METHOD AND SYSTEM WITH INVERTER COMPRESSOR

(71) Applicant: QINGDAO HAIER JOINT STOCK CO., LTD., Qingdao, Shandong Province (CN)

(72) Inventors: Lisheng Ji, Qingdao (CN); Jianru Liu, Qingdao (CN); Xiaobing Zhu, Qingdao (CN); Feifei Qi, Qingdao (CN); Shufeng Zhang, Qingdao (CN); Caiyun Zhao, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 33 days.

(21) Appl. No.: 15/770,202

(22) PCT Filed: Jun. 17, 2016

(86) PCT No.: PCT/CN2016/086166
§ 371 (c)(1),
(2) Date: Apr. 21, 2018

(87) PCT Pub. No.: WO2017/076001
PCT Pub. Date: May 11, 2017

(65) Prior Publication Data

US 2018/0266755 A1 Sep. 20, 2018

(30) Foreign Application Priority Data

Nov. 5, 2015 (CN) ..... 2015 1 0746342

(51) Int. Cl.
*F25B 49/02* (2006.01)
*F25D 29/00* (2006.01)
(Continued)

(52) U.S. Cl.
CPC ..... *F25D 29/005* (2013.01); *F25B 49/022* (2013.01); *F25B 49/025* (2013.01);
(Continued)

(58) Field of Classification Search
None
See application file for complete search history.

(56) References Cited

U.S. PATENT DOCUMENTS 5,711,159 A * 1/1998 Whipple, III ..... F25D 17/065 62/186
8,539,786 B2 9/2013 McSweeney
(Continued)

FOREIGN PATENT DOCUMENTS

CN 101363653 A 2/2009
CN 101603751 A 12/2009
(Continued)

OTHER PUBLICATIONS

Engineering Tool Box, (2003). Conductive Heat Transfer. [online] Available at: https://www.engineeringtoolbox.com/conductive-heat-transfer-d_428.html [Accessed Jul. 18, 2019].*

*Primary Examiner* — Edward F Landrum
*Assistant Examiner* — Daniel C Comings
(74) *Attorney, Agent, or Firm* — Cheng-Ju Chiang

(57) ABSTRACT

A control method and control system of a refrigerator with an inverter compressor. The control method includes: calculating the total cooling amount needed by a compartment to be cooled within a unit time; taking the total cooling amount as a first power of the inverter compressor and calculating a first frequency of the inverter compressor operating at the first power; and controlling the inverter compressor to operate at the first frequency. The present invention effectively controls the power consumption amount while satisfying the refrigerator cooling condition
(Continued)

by calculating the total cooling amount needed by a refrigerator compartment within a unit time and adjusting the frequency of the inverter compressor.

8 Claims, 4 Drawing Sheets

(51) Int. Cl.
*F25D 23/02* (2006.01)
*F25D 23/12* (2006.01)

(52) U.S. Cl.
CPC ..... *F25D 23/023* (2013.01); *F25D 23/12* (2013.01); *F25D 29/00* (2013.01); *F25B 2500/19* (2013.01); *F25B 2600/021* (2013.01); *F25D 2600/06* (2013.01)

(56) References Cited

U.S. PATENT DOCUMENTS

2005/0284163 A1* 12/2005 Hwang ..... F25B 13/00 62/222
2009/0007575 A1* 1/2009 Kaga ..... F25B 49/02 62/126
2011/0061411 A1* 3/2011 Kim ..... F04B 35/045 62/132
2014/0260409 A1* 9/2014 Junge ..... F25B 5/02 62/419
2015/0040597 A1* 2/2015 Ariyama ..... F25B 13/00 62/180

FOREIGN PATENT DOCUMENTS

| | | | |
|---|---|---|---|
| CN | 102128481 | A | 7/2011 |
| CN | 102735018 | A | 10/2012 |
| CN | 202709632 | U | 1/2013 |
| CN | 104279836 | A | 1/2015 |
| CN | 104515245 | A | 4/2015 |
| CN | 104990222 | A | 10/2015 |
| CN | 105258445 | A | 1/2016 |
| JP | 2005-300098 | A | 10/2005 |
| WO | 2005/047700 | A1 | 5/2005 |

* cited by examiner

REFRIGERATOR CONTROL METHOD AND SYSTEM WITH INVERTER COMPRESSOR

CROSS REFERENCE TO RELATED APPLICATIONS

The present application is a 35 U.S.C. § 371 National Phase conversion of International (PCT) Patent Application No. PCT/CN2016/086166, filed on Jun. 17, 2016, which further claims benefit of Chinese Patent Application No. 201510746342.2, filed on Nov. 5, 2015, the disclosure of which is incorporated by reference herein. The PCT International Patent Application was filed and published in Chinese.

TECHNICAL FIELD

The present invention relates to the technical field of refrigerator cooling control, and in particular to a refrigerator control method and control system with an inverter compressor.

BACKGROUND

Refrigerators usually include multi-cooling system refrigerators (direct-cooling refrigerators) and single-cooling system refrigerators (air-cooled refrigerators). The multi-cooling system includes a plurality of cooling paths for the coolant to pass through and an inverter compressor connected to all cooling paths, each cooling path being provided with an evaporator. The single-cooling system includes a cooling path for the coolant to pass through and an inverter compressor connected to the cooling path, the cooling path being provided with an evaporator.

In a multi-cooling system refrigerator applying multi-evaporator, the heating loads needed by the coolant when passing through different cooling paths are different, thus the needed cooling amount is different. In the prior art, the inverter compressor adopts the same input frequency despite the inverter compressor controls the coolant to pass through which path, which inevitably causes the cooling amount generated by the inverter compressor to be excessive when the coolant passes through some cooling paths, thus causing increased power consumption.

In a single-cooling system air-cooled refrigerator applying a single evaporator, there is usually a through air door between the refrigeration compartment and the freezing compartment. When the refrigeration compartment needs to perform cooling, the air door will be opened. When the refrigeration compartment does not need to perform cooling, the air door will be closed. When the refrigeration air door is opened, the cooling amount provided by the inverter compressor needs to satisfy the cooling requirements of refrigeration and freezing. When the air door is closed, the cooling amount provided by the inverter compressor merely needs to satisfy the cooling requirements of the freezing compartment. In the prior art, despite the inverter compressor controls the air door to open or close, the inverter compressor adopts the same input frequency, which inevitably causes the cooling amount generated by the inverter compressor to be excessive when the coolant passes through some cooling paths, thus causing increased power consumption.

SUMMARY

With respect to the defects in the prior art, the technical problem to be solved by the present invention is to provide a control method and control system of a refrigerator with an inverter compressor to control the frequency of the inverter compressor.

In order to solve the above technical problem, the technical solution of the present invention is implemented as follows.

A control method of a refrigerator with a inverter compressor, comprising: calculating the total cooling amount needed by a compartment to be cooled within a unit time; taking the total cooling amount as a first power of the inverter compressor and calculating a first frequency of the inverter compressor operating at the first power; and controlling the inverter compressor to operate at the first frequency.

As a further improvement to the present invention, calculating the total cooling amount needed by the compartment to be cooled within the unit time comprises: calculating the heat conducted by the heat conduction walls of each compartment to be cooled within a unit time, the calculation formula of the heat conducted by each heat conduction wall being: $\Phi=\lambda A\Delta T/\delta$, where $\Phi$ is the heat conducted by the heat conduction wall within a unit time, A is the area of the heat conduction wall, $\lambda$ is the heat conduction rate of the heat conduction wall, $\delta$ is the thickness of the heat conduction wall, and $\Delta T$ is the temperature difference between two surfaces of the heat conduction wall, that is, the difference between the ambient temperature and the compartment temperature; calculating the sum of the heat conducted by the heat conduction walls of each compartment to be cooled to obtain the cooling amount needed by the compartments to be cooled; and calculating the sum of the cooling amounts needed by the compartments to be cooled to obtain the total cooling amount.

As a further improvement to the present invention, the method for determining the compartment to be cooled is: monitoring the compartment temperature T in each compartment; comparing the compartment temperature in the compartment to a preset compartment temperature threshold T0 corresponding to each compartment; and if the compartment temperature T is greater than the corresponding preset compartment temperature threshold T0, then deeming that the compartment needs to be cooled; and if the compartment temperature T is less than or equal to the corresponding preset compartment temperature threshold T0, then deeming that the compartment does not need to be cooled.

As a further improvement to the present invention, the method further comprises: monitoring whether the compartment to be cooled has changed; if yes, then recalculating the total cooling amount needed by the compartment to be cooled within a unit time, taking the current total cooling amount as a second power of the inverter compressor, calculating a second frequency of the inverter compressor operating at the second power, and controlling the inverter compressor to operate at the second frequency; and if not, then controlling the inverter compressor to continue operating at the first frequency.

As a further improvement to the present invention, monitoring whether the compartment to be cooled has changed is: monitoring whether the state of an air door in a cooling loop of a single-cooling system air-cooled refrigerator has changed.

As a further improvement to the present invention, monitoring whether the compartment to be cooled has changed is: monitoring whether at least one of the states of the air doors in the cooling loops of a multi-cooling system air-cooled refrigerator has changed.

As a further improvement to the present invention, the method further comprises: after the inverter compressor has operated for a predetermined period of time, recalculating the total cooling amount needed by the compartment to be cooled within a unit time; taking the current total cooling amount as a third power of the inverter compressor and calculating a third frequency of the inverter compressor operating at the third power; and controlling the inverter compressor to operate at the third frequency.

Accordingly, there is provided a control system of a refrigerator adopting a inverter compressor, comprising: a temperature monitoring device and a main control board connected to the temperature monitoring device, wherein the temperature monitoring device comprises a first temperature monitoring device provided external to the refrigerator for monitoring the operating ambient temperature of the refrigerator and a plurality of second temperature monitoring devices respectively provided in the compartments of the refrigerator for monitoring the compartment temperature in the compartments; and the main control board is configured for: calculating the total cooling amount needed by a compartment to be cooled within a unit time; taking the total cooling amount as a first power of the inverter compressor and calculating a first frequency of the inverter compressor operating at the first power; and controlling the inverter compressor to operate at the first frequency.

As a further improvement to the present invention, the main control board is further configured for: calculating the heat conducted by the heat conduction walls of each compartment to be cooled within the unit time, the calculation formula of the heat conducted by each heat conduction wall being: $\Phi=\lambda A\Delta T/\delta$, where $\Phi$ is the heat conducted by the heat conduction wall within the unit time, A is the area of the heat conduction wall, $\lambda$ is the heat conduction rate of the heat conduction wall, $\delta$ is the thickness of the heat conduction wall, and $\Delta T$ is the temperature difference between two surfaces of the heat conduction wall, that is, the difference between the ambient temperature and the compartment temperature; calculating the sum of the heat conducted by the heat conduction walls of each compartment to be cooled to obtain the cooling amount needed by the compartments to be cooled; and calculating the sum of the cooling amounts needed by the compartments to be cooled to obtain the total cooling amount.

As a further improvement to the present invention, the main control board is further configured for: comparing the compartment temperature in the compartment to a preset compartment temperature threshold T0 corresponding to each compartment; and if the compartment temperature T is greater than the corresponding preset compartment temperature threshold T0, then deeming that the compartment needs to be cooled; and if the compartment temperature T is less than or equal to the corresponding preset compartment temperature threshold T0, then deeming that the compartment does not need to be cooled.

As a further improvement to the present invention, the main control board is further configured for: monitoring whether the compartment to be cooled has changed; if yes, then recalculating the total cooling amount needed by the compartment to be cooled within the unit time, taking the current total cooling amount as a second power of the inverter compressor, calculating a second frequency of the inverter compressor operating at the second power, and controlling the inverter compressor to operate at the second frequency; and if not, then controlling the inverter compressor to continue operating at the first frequency.

As a further improvement to the present invention, the main control board is further configured for monitoring whether the state of an air door in a cooling loop of a single-system air-cooled refrigerator has changed.

As a further improvement to the present invention, the main control board is further configured for monitoring whether at least one of the states of the air doors in the cooling loops of a multi-cooling system air-cooled refrigerator has changed.

As a further improvement to the present invention, the main control board is further configured for: after the inverter compressor has operated for a predetermined period of time, recalculating the total cooling amount needed by the compartment to be cooled within a unit time; taking the current total cooling amount as a third power of the inverter compressor and calculating a third frequency of the inverter compressor operating at the third power; and controlling the inverter compressor to operate at the third frequency.

The beneficial effects of the present invention are as follows: the present invention effectively controls the power consumption amount while satisfying the refrigerator cooling condition by calculating the total cooling amount needed by a refrigerator compartment within a unit time and adjusting the frequency of the inverter compressor.

DETAILED DESCRIPTION

Figure 1:
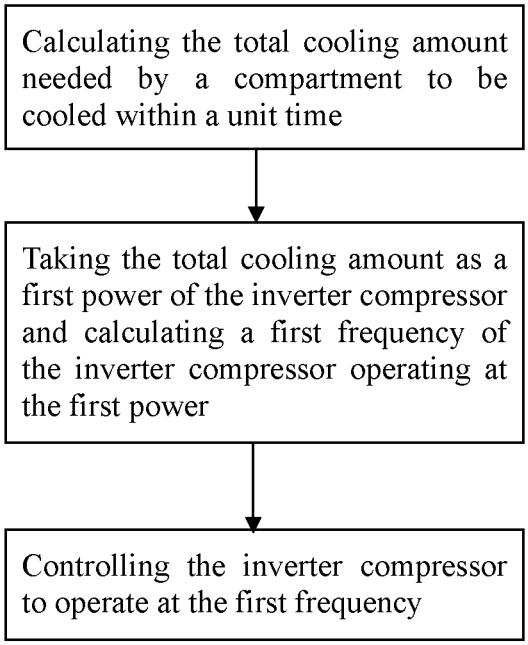
FIG. 1 is a flowchart of a control method of a refrigerator adopting an inverter compressor according to a first implementation of the present invention.

In order to make the purposes, technical solutions and advantages of the invention more clear, specific implementations of this invention are described in accompany with the drawings as follows. These preferred implementations are exemplified in the drawings. Implementations of this invention as illustrated in the drawings and described in accordance with the drawings are merely illustrative, and this invention is not limited to these implementations.

It is to be noted that, in order to avoid blurring the invention because of unnecessary details, the drawings only show the structures and/or processing steps which are closely related to the solutions of this invention, but omit the other details with little relationship with this invention.

In addition, it is also to be noted that, the terms "comprise" and "include" or any of their other variants aim to cover non-exclusive containing relationships, so that the processes, methods, articles or equipment including a series of elements not only include those elements, but also include other elements not explicitly listed, or also include elements inherent in these processes, methods, articles or equipment.

FIG. 1 shows a control method of a refrigerator adopting an inverter compressor according to a first implementation of the present invention. The control method comprises: calculating the total cooling amount needed by a compartment to be cooled within a unit time; taking the total cooling amount as a first power of the inverter compressor and calculating a first frequency of the inverter compressor operating at the first power; and controlling the inverter compressor to operate at the first frequency.

Figure 2:
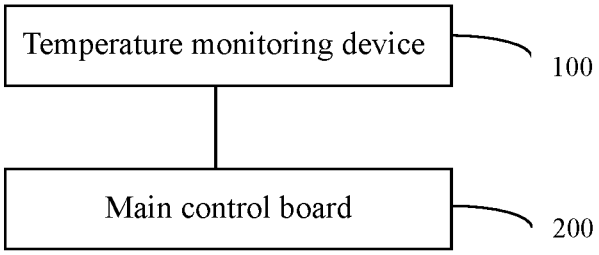
FIG. 2 is a modular diagram of a control system of a refrigerator adopting an inverter compressor according to a first implementation of the present invention.

Accordingly, FIG. 2 shows a control system of a refrigerator adopting an inverter compressor in this implementation. The control system comprises: a temperature monitoring device 100 and a main control board 200 connected to the temperature monitoring device 100. The temperature monitoring device 100 comprises a first temperature monitoring device provided external to the refrigerator for monitoring the operating ambient temperature of the refrigerator and a plurality of second temperature monitoring devices respectively provided in the compartments of the refrigerator for monitoring the compartment temperature in the compartments. The main control board 200 is configured for: calculating the total cooling amount needed by a compartment to be cooled within a unit time; taking the total cooling amount as a first power of the inverter compressor and calculating a first frequency of the inverter compressor operating at the first power; and controlling the inverter compressor to operate at the first frequency.

In the present invention, the heating load of the refrigerator is equal to the total cooling amount required by the compartments. As the compartments of the refrigerator are formed by the enclosure of heat conduction walls (foaming layers), the total cooling amount required by the compartments is the total heat conducted by the heat conduction walls. In order to maintain that the inverter compressor can satisfy the cooling condition of the refrigerator during operation and will not cause cooling amount waste, in this implementation, the total cooling amount of the compartments within a unit time is maintained to be equal to the instantaneous power of the inverter compressor.

The calculation of the total cooling amount within the unit time includes the following steps: calculating the heat conducted by the heat conduction walls of each compartment to be cooled within a unit time, the calculation formula of the heat conducted by each heat conduction wall being: $\Phi=\lambda A\Delta T/\delta$, where $\Phi$ is the heat conducted by the heat conduction wall within a unit time, A is the area of the heat conduction wall ($m^2$), $\lambda$ is the heat conduction rate of the heat conduction wall [w/(m·K)], $\delta$ is the thickness of the heat conduction wall (m), and $\Delta T$ is the temperature difference between two surfaces of the heat conduction wall (° C.), that is, the difference between the ambient temperature and the compartment temperature; calculating the sum of the heat conducted by the heat conduction walls of each compartment to be cooled to obtain the cooling amount needed by the compartments to be cooled; and calculating the sum of the cooling amounts needed by the compartments to be cooled to obtain the total cooling amount.

In this implementation, the heat conduction wall being a flat wall is taken as an example. With the above equation $\Phi=\lambda A\Delta T/\delta$, the heat conducted by the heat conduction walls of each compartment within a unit time can be calculated. The sum of the heat conducted by all heat conduction walls within a unit time is the cooling amount of this compartment within a unit time. Each compartment usually includes 6 heat conduction walls, namely, the upper, lower, left, right, front and back heat conduction walls. The sum of the heat conduction by the 6 heat conduction walls is the cooling amount of this cooling compartment.

It should be understood that in this implementation, each compartment having 6 heat conduction walls is taken as an example for description, and in other implementations, other number of heat conduction walls can also be set, which will be not be described here.

Figure 3:
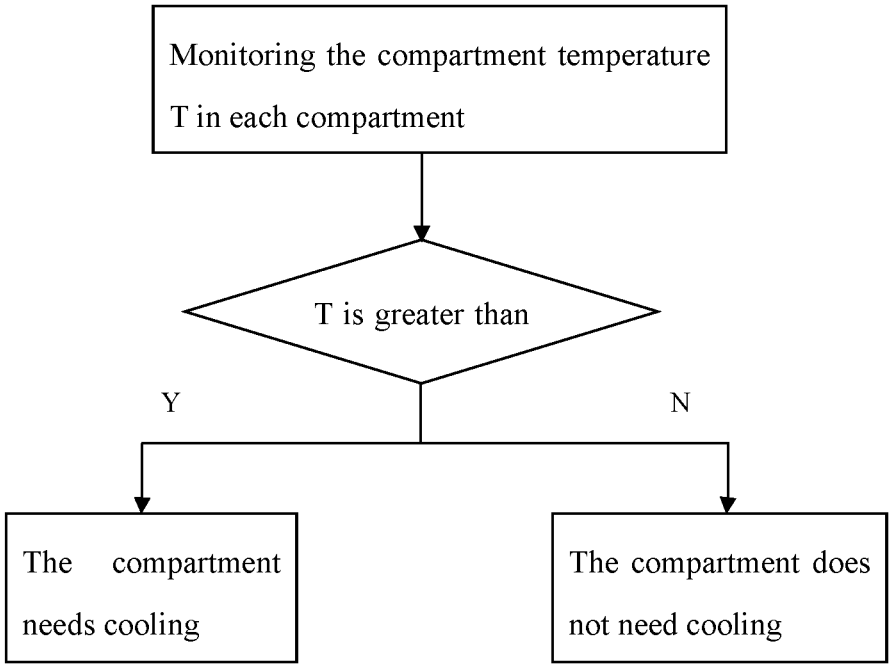
FIG. 3 is a flowchart of a method for determining a compartment to be cooled according to a first implementation of the present invention.

Furthermore, as shown in FIG. 3, the method for determining the compartment to be cooled is: monitoring the compartment temperature T in each compartment; comparing the compartment temperature in the compartment to a preset compartment temperature threshold T0 corresponding to each compartment; and if the compartment temperature T is greater than the corresponding preset compartment temperature threshold T0, then deeming that the compartment needs to be cooled; and if the compartment temperature T is less than or equal to the corresponding preset compartment temperature threshold T0, then deeming that the compartment does not need to be cooled.

The present invention can be applied to various types of refrigerators, such as single-cooling system air-cooled refrigerators, multi-cooling system air-cooled refrigerators, multi-cooling system direct-cooling refrigerators and so on. Hereinafter, this implementation will be described further in conjunction with particular embodiments.

In a first embodiment of the present invention, a single-cooling system air-cooled refrigerator is taken as an example for description. This refrigerator includes two compartments, i.e., a refrigeration compartment and a freezing compartment. An air door for controlling the cooling of the refrigeration compartment is provided between the refrigeration compartment and the freezing compartment. A first temperature monitoring device is provided external to the refrigerator for monitoring the operating ambient temperature of the refrigerator. A plurality of second temperature monitoring devices are provided in the refrigeration compartment and the freezing compartment of the refrigerator respectively for monitoring the compartment temperature in the compartment.

The state of an air door in a cooling loop is determined according to the comparison of the compartment temperature detected by the second temperature monitoring device and a preset compartment temperature threshold. For example, in this embodiment, the preset temperature threshold T01 of the refrigeration compartment is 0° C., and the preset temperature threshold T02 of the freezing compartment is −15° C.

If it is monitored that the compartment temperature of the freezing compartment is less than or equal to −15° C., it indicates that the freezing compartment does not need cooling. Then the inverter compressor will be shut down. If it is monitored that the compartment temperature of the freezing compartment is greater than −15° C., it indicates that the freezing compartment needs cooling. The compartment temperature of the refrigeration compartment will be further monitored. The following two situations are included.

1. If it is monitored that the compartment temperature of the refrigeration compartment is greater than 0° C., then the air door will be opened and the freezing compartment and the refrigeration compartment will be cooled simultaneously. At this moment: the total cooling amount needed by the refrigeration compartment and the freezing compartment within a unit time is calculated; the total cooling amount is taken as a first power of the inverter compressor and a first frequency of the inverter compressor operating at the first power is calculated; and the inverter compressor is controlled to operate at the first frequency.

2. If it is monitored that the compartment temperature of the refrigeration compartment is less than or equal to 0° C., then the air door will be closed and merely the freezing compartment will be cooled. At this moment: the total cooling amount needed by the freezing compartment within a unit time is calculated; the total cooling amount is taken as a first power of the inverter compressor and a first frequency of the inverter compressor operating at the first power is calculated; and the inverter compressor is controlled to operate at the first frequency.

In a second embodiment of the present invention, a multi-cooling system air-cooled refrigerator is taken as an example for description. This refrigerator includes a plurality of cooling systems. Each cooling system includes two compartments, i.e., a refrigeration compartment and a freezing compartment. An air door for controlling the cooling of the refrigeration compartment is provided between each refrigeration compartment and each freezing compartment. A first temperature monitoring device is provided external to the refrigerator for monitoring the operating ambient temperature of the refrigerator. A plurality of second temperature monitoring devices is provided in the refrigeration compartment and the freezing compartment respectively for monitoring the compartment temperatures in the compartments.

The cooling system to be cooled is determined according to the compartment temperature in the freezing compartments. The state of the air door in the corresponding cooling system is determined according to the compartment temperature of the refrigeration compartment in the cooling system to be cooled. Finally, the total cooling amount within a unit time is calculated to control the frequency of the inverter compressor. The control method of each cooling system is the same as the first embodiment, which will not be described here anymore.

In a third embodiment of the present invention, a multi-cooling system direct-cooling refrigerator is taken as an example for description. For example, this refrigerator includes two compartments, i.e., a refrigeration compartment and a freezing compartment. The coolant flows to the refrigeration compartment and the freezing compartment respectively. A first temperature monitoring device is provided external to the refrigerator for monitoring the operating ambient temperature of the refrigerator. A plurality of second temperature monitoring devices are provided in the refrigeration compartment and the freezing compartment of the refrigerator respectively for monitoring the compartment temperatures in the compartments.

The flow direction of the coolant is determined according to the comparison of the compartment temperature detected by the second temperature monitoring device and a preset compartment temperature threshold. For example, in this embodiment, the preset temperature threshold T01 of the refrigeration compartment is 0° C., and the preset temperature threshold T02 of the freezing compartment is −15° C.

If it is monitored that the compartment temperature of the freezing compartment is less than or equal to −15° C., it indicates that the freezing compartment does not need cooling, otherwise, the freezing compartment needs cooling. If it is monitored that the compartment temperature of the refrigeration compartment is less than or equal to 0° C., it indicates that the refrigeration compartment does not need cooling. Otherwise, the refrigeration compartment needs cooling.

The control method includes: after the compartment to be cooled and the flow direction of the coolant are determined, calculating the total cooling amount needed by the refrigeration compartment and/or the freezing compartment within the unit time; taking the total cooling amount as a first power of the inverter compressor and calculating a first frequency of the inverter compressor operating at the first power; and controlling the inverter compressor to operate at the first frequency.

Figure 4:
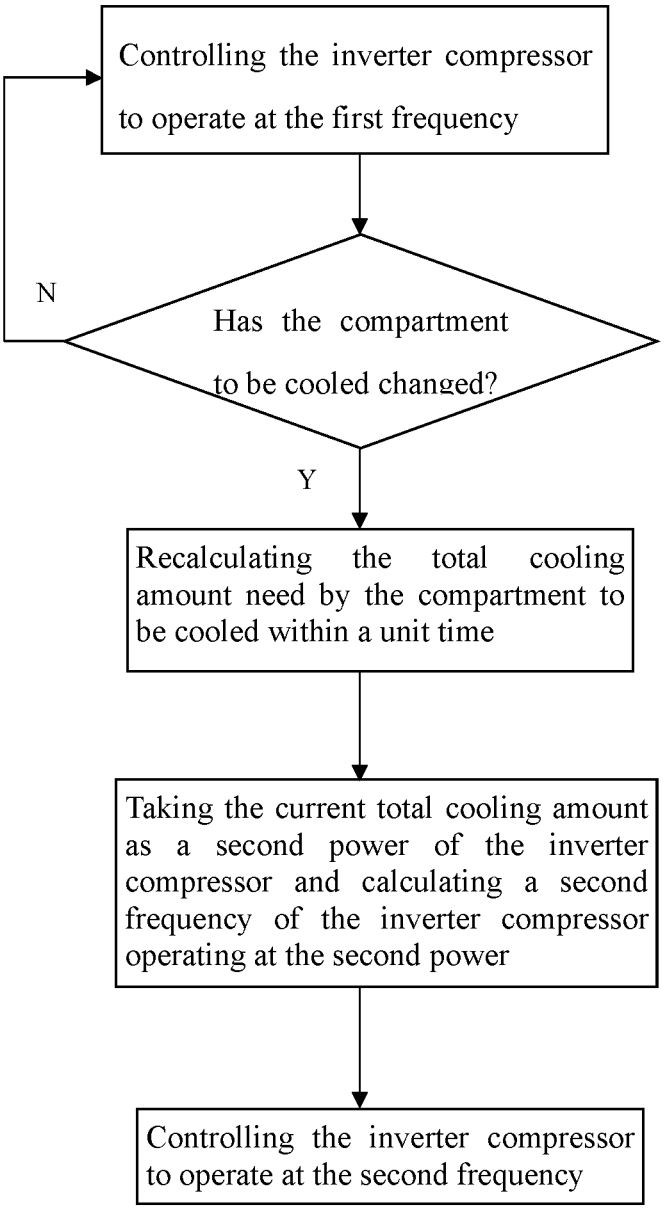
FIG. 4 is a flowchart of a control method of a refrigerator adopting an inverter compressor according to a second implementation of the present invention.

FIG. 4 shows a control method of a refrigerator adopting an inverter compressor according to a second implementation of the present invention. The control method further comprises: after the first implementation, monitoring whether the compartment to be cooled has changed; if yes, then recalculating the total cooling amount needed by the compartment to be cooled within the unit time, taking the current total cooling amount as a second power of the inverter compressor, calculating a second frequency of the inverter compressor operating at the second power, and controlling the inverter compressor to operate at the second frequency; and if not, then controlling the inverter compressor to continue operating at the first frequency.

"Monitoring whether the compartment to be cooled has changed" is to monitor whether a new cooling compartment is opened during the operation of the refrigerator and/or a cooling compartment is closed after reaching the target temperature, including but not limited to the following three situations: monitoring whether the state of the air door in the single-cooling system air-cooled refrigerator has changed; monitoring whether the cooling loop is shut down and/or started in a multi-cooling system air-cooled refrigerator and whether the state of the air door has changed; and monitoring whether the flow direction of the coolant in a multi-cooling system direct-cooling refrigerator has changed.

In the first to the third implementations, if there is a new cooling compartment opened and/or a cooling compartment is closed after reaching the target temperature, then the total cooling amount needed by the compartment to be cooled within a unit time is recalculated to control the inverter compressor to operate at the second frequency. The particular control method can be referred to the first implementation, which will not be described here anymore.

Figure 5:
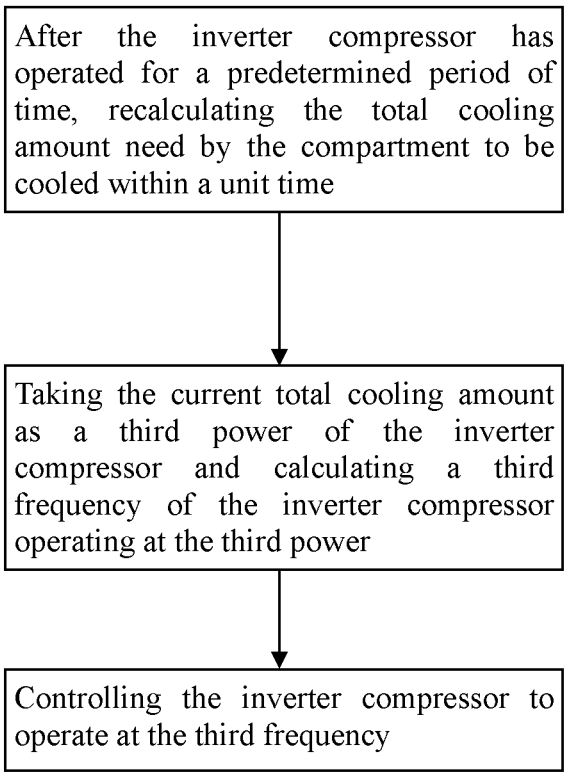
FIG. 5 is a flowchart of a control method of a refrigerator adopting an inverter compressor according to a third implementation of the present invention.

FIG. 5 shows a control method of a refrigerator adopting an inverter compressor according to a second implementation of the present invention. After the first implementation, the control method further comprises: after the inverter compressor has operated for a predetermined period of time, recalculating the total cooling amount needed by the compartment to be cooled within the unit time; taking the current total cooling amount as a third power of the inverter compressor and calculating a third frequency of the inverter compressor operating at the third power; and controlling the inverter compressor to operate at the third frequency.

In particular, when the refrigerator operates, the temperature in the compartment of the refrigerator will gradually decrease. After the temperature of the compartment decreases, the total cooling amount of the refrigerator will decrease accordingly. At this moment, if the inverter compressor still operates at the first frequency, then it will cause the cooling amount generated by the compressor to be excessive, thus causing increased power consumption. Therefore, in this implementation, the total cooling amount needed by the compartment to be cooled within a unit time is recalculated after the inverter compressor has operated for a predetermined period of time. Then the frequency of the inverter compressor is controlled to be a third frequency according to the current total cooling amount, the third frequency being less than the first frequency.

In addition, in this implementation, the "predetermined period of time" can be set according to different refrigerators and different operating environments, such as 30 min, 1 h and so on. The refrigerator repeats the calculation of the total cooling amount every the predetermined period of time and updates the third frequency.

It should be understood that in other implementations of the present invention, the total cooling amount needed by the compartment to be cooled within the unit time can be calculated in real time so as to control the frequency of the inverter compressor to gradually decrease in real time.

It can be seen from the above technical solutions that the present invention effectively controls the power consumption amount while satisfying the refrigerator cooling condition by calculating the total cooling amount needed by a refrigerator compartment within a unit time and adjusting the frequency of the inverter compressor.

It should be understood that, although the specification is described in accordance with implementations, not every implementation only contains a separate technical solution. This sort of narrative description manner in the specification is just for the sake of clarity. Those skilled in the art should take the specification as a whole. The technical solution in each implementation can also be combined to form other implementations which those skilled in the art can understand.

The above detailed descriptions are only specific for the feasible implementations of the present application. They are not used to limit the protection scope of the present application. Any equivalent implementation or modification made without breaking away from the spirit of the application shall fall within the protection scope of the present application.

What is claimed is:

1. A control method of a refrigerator adopting an inverter compressor, comprising:

calculating a total cooling amount needed by a compartment to be cooled within a unit time;

taking the total cooling amount as a first power of the inverter compressor and calculating a first frequency of the inverter compressor operating at the first power; and controlling the inverter compressor to operate at the first frequency;

wherein the control method further comprises a method for determining the compartment to be cooled which is:

monitoring the compartment temperature T in each compartment;

comparing the compartment temperature in the compartment to a preset compartment temperature threshold T0 corresponding to each compartment; and if the compartment temperature T is greater than the corresponding preset compartment temperature threshold T0, then deeming that the compartment needs to be cooled; and if the compartment temperature T is less than or equal to the corresponding preset compartment temperature threshold T0, then deeming that the compartment does not need to be cooled;

monitoring whether the compartment to be cooled has changed; and if yes, then recalculating the total cooling amount needed by the compartment to be cooled within the unit time, taking the current total cooling amount as a second power of the inverter compressor, calculating a second frequency of the inverter compressor operating at the second power, and controlling the inverter compressor to operate at the second frequency; and if not, then controlling the inverter compressor to continue operating at the first frequency;

after the inverter compressor has operated for a predetermined period of time, recalculating the total cooling amount needed by the compartment to be cooled within the unit time;

taking the current total cooling amount as a third power of the inverter compressor and calculating a third frequency of the inverter compressor operating at the third power;

controlling the inverter compressor to operate at the third frequency; and repeating the recalculation of the total cooling amount at every time when the inverter compressor operates at the third frequency for the predetermined period of time, and updating the third frequency based on the repeated recalculation of the total cooling amount, the third frequency being less than the first frequency.

2. The control method according to claim 1, wherein calculating the total cooling amount needed by the compartment to be cooled within the unit time comprises:

calculating heat conducted by heat conduction walls of each compartment to be cooled out of at least two compartments to be cooled within the unit time, the calculation formula of the heat conducted by each heat conduction wall being:

$$\Phi=\lambda A\Delta T/\delta;$$

where $\Phi$ is the heat conducted by the heat conduction wall within the unit time, A is the area of the heat conduction wall, $\lambda$, is the heat conduction rate of the heat conduction wall, $\delta$ is the thickness of the heat conduction wall, and $\Delta T$ is the temperature difference between two surfaces of the heat conduction wall, that is, the difference between the ambient temperature and the compartment temperature;

calculating the sum of the heat conducted by the heat conduction walls of each compartment to be cooled to obtain the cooling amount needed by the compartments to be cooled; and calculating the sum of the cooling amounts needed by the at least two compartments to be cooled to obtain the total cooling amount.

3. The control method according to claim 1, wherein monitoring whether the compartment to be cooled has changed is:

monitoring whether the state of an air door in a cooling loop of a single-cooling system air-cooled refrigerator has changed.

4. The control method according to claim 1, wherein monitoring whether the compartment to be cooled has changed is:

monitoring whether at least one of states of air doors in cooling loops of a multi-cooling system air-cooled refrigerator has changed.

5. A control system of a refrigerator adopting an inverter compressor, comprising: a temperature monitoring device and a main control board connected to the temperature monitoring device, wherein:

the temperature monitoring device comprises:

a first temperature monitoring device provided external to the refrigerator for monitoring an operating ambient temperature of the refrigerator and a plurality of second temperature monitoring devices respectively provided in compartments of the refrigerator for monitoring compartment temperatures in the compartments; and the main control board is configured for:

calculating a total cooling amount needed by a compartment to be cooled within a unit time;

taking the total cooling amount as a first power of the inverter compressor and calculating a first frequency of the inverter compressor operating at the first power;

controlling the inverter compressor to operate at the first frequency;

comparing the compartment temperature in the compartment to a preset compartment temperature threshold T0 corresponding to each compartment; and if the compartment temperature T is greater than the corresponding preset compartment temperature threshold T0, then deeming that the compartment needs to be cooled; and if the compartment temperature T is less than or equal to the corresponding preset compartment temperature threshold T0, then deeming that the compartment does not need to be cooled;

monitoring whether the compartment to be cooled has changed;

if yes, then recalculating the total cooling amount needed by the compartment to be cooled within the unit time, taking the current total cooling amount as a second power of the inverter compressor, calculating a second frequency of the inverter compressor operating at the second power, and controlling the inverter compressor to operate at the second frequency; and if not, then controlling the inverter compressor to continue operating at the first frequency;

after the inverter compressor has operated for a predetermined period of time, recalculating the total cooling amount needed by the compartment to be cooled within the unit time;

taking the current total cooling amount as a third power of the inverter compressor and calculating a third frequency of the inverter compressor operating at the third power;

controlling the inverter compressor to operate at the third frequency; and repeating the recalculation of the total cooling amount at every time when the inverter compressor operates at the third frequency for the predetermined period of time, and updating the third frequency based on the repeated recalculation of the total cooling amount;

the third frequency being less than the first frequency.

6. The control system according to claim 5, wherein the main control board is further configured for:

calculating heat conducted by heat conduction walls of each compartment to be cooled out of at least two compartments to be cooled within the unit time, the calculation formula of the heat conducted by each heat conduction wall being:

$$\Phi=\lambda A\Delta T/\delta;$$

where $\Phi$ is the heat conducted by the heat conduction wall within a unit time, A is the area of the heat conduction wall, $\lambda$, is the heat conduction rate of the heat conduction wall, $\delta$ is the thickness of the heat conduction wall, and $\Delta T$ is the temperature difference between two surfaces of the heat conduction wall, that is, the difference between the ambient temperature and the compartment temperature;

calculating the sum of the heat conducted by the heat conduction walls of each compartment to be cooled to obtain the cooling amounts respectively needed by the compartments to be cooled; and calculating the sum of the cooling amounts needed by the at least two compartments to be cooled to obtain the total cooling amount.

7. The control system according to claim 5, wherein the main control board is further configured for monitoring whether the state of an air door in a cooling loop of a single-system air-cooled refrigerator has changed.

8. The control system according to claim 5, wherein the main control board is further configured for monitoring whether at least one of states of air doors in cooling loops of a multi-system air-cooled refrigerator has changed.

* * * * *